United States Patent [19]

Mai et al.

[11] Patent Number: 4,484,344

[45] Date of Patent: Nov. 20, 1984

[54] VOICE OPERATED SWITCH

[75] Inventors: Don L. Mai, Garland; Bruce W. Campbell, Richardson, both of Tex.

[73] Assignee: Rockwell International Corporation, El Segundo, Calif.

[21] Appl. No.: 353,670

[22] Filed: Mar. 1, 1982

[51] Int. Cl.[3] ..... G10L 1/00

[52] U.S. Cl. ..... 381/46; 381/110

[58] Field of Search ..... 381/46, 110

[56] References Cited

U.S. PATENT DOCUMENTS 3,555,192 1/1971 Hymer ..... 381/110

4,052,568 10/1977 Jankowski ..... 381/46

4,187,396 2/1980 Luhowy ..... 381/46

*Primary Examiner*—E. S. Matt Kemeny

*Attorney, Agent, or Firm*—Roger N. Chauza; V. Lawrence Sewell; H. Fredrick Hamann

[57] ABSTRACT

A voice operated switch having minimum signal amplification in the stages which separate the voice signals from the noise signals. The majority of amplification is then applied only to the syllabic rate voice component detected by an offset threshold in the syllabic rectifier-amplifier circuit to produce a two-state signal, one state representative of the presence of voice energy and the other state representative of the absence of voice energy. The two states are compared with a threshold voltage adjustable between a maximum and minimum voltage. A maximum and minimum setting allow a respective nontransmission and transmission of the voice signals irrespective of the presence or absence of such signals.

8 Claims, 2 Drawing Figures

VOICE OPERATED SWITCH

BACKGROUND OF THE INVENTION

The invention disclosed herein pertains generally to voice detection circuits, and more particularly to voice operated switches employing syllabic rate detection circuits.

Voice operated switches (VOX's) find a variety of applications in communication radio receivers. Used in a squelch circuit, the VOX can enable audio output from a receiver only upon the reception of voice signals so that the listener is not burdened with listening to a constant level of background noise. Voice operated switches may also have a particular utility in controlling the application of power to a transmitter, or the like, such that the transmitter is powered up only during the reception of voice signals. It is apparent that the application of power only during the useful period of a transmitter can result in substantial economical benefits.

It is well known in the art that a transmission channel can be controlled by the type of voice operated switches which detect the presence or absence of voice energy vis a vis noise energy. While this method of voice detection is simple, it is subject to false triggering due to the inability to discriminate between the presence of voice and non-voice energy components.

Another voice detection method divides the voice band into two frequency bands such that the majority of voice energy falls into a lower band. The voice signals plus noise in this lower band are then compared with the noise energy in the upper band to determine the presence or absence of a voice signal. This method of voice detection is commonly known as the two-band energy detection method.

A third method, the syllabic rate detection method, overcomes the noted discrimination problem by first detecting the composite voice and noise envelope, then passing the envelope through a syllabic rate band pass filter to define the presence or absence of syllabic rate energy.

SUMMARY OF THE INVENTION

The voice operated switch according to the present invention employs a conventional low-pass filter, envelope detector and syllabic rate filter to separate the voice signals from the noise signals. Such stages process the voice and noise signals with minimum amplification so as to preserve the signal to noise ratio. The syllabic rate filter provides an indication of the presence of the voice signal, separate from the noise. This syllabic rate energy is then amplified by the majority of the circuit gain.

The major amplification is of sufficient magnitude to produce a two-state signal. This two-state signal is then compared with a reference potential to derive another signal for enabling or disabling the transmission channel switch. Each state of the two-state signal determinatively defines the presence or absence of a voice signal and thereby alleviates the need to make adjustments for compensating changes in the voice signal level. The invention therefore represents an advance in the art of discerning voice signals from noise signals.

In the preferred embodiment, the maximum voltage of the reference potential is greater than the high state, and the minimum reference potential is less than the low state. This allows an adjustment of the reference potential to a maximum voltage or to a minimum voltage to assure a respective permanent disabling or enabling of the transmission channel.

DETAILED DESCRIPTION OF THE PREFERRED EMBODIMENT

Figure 1:
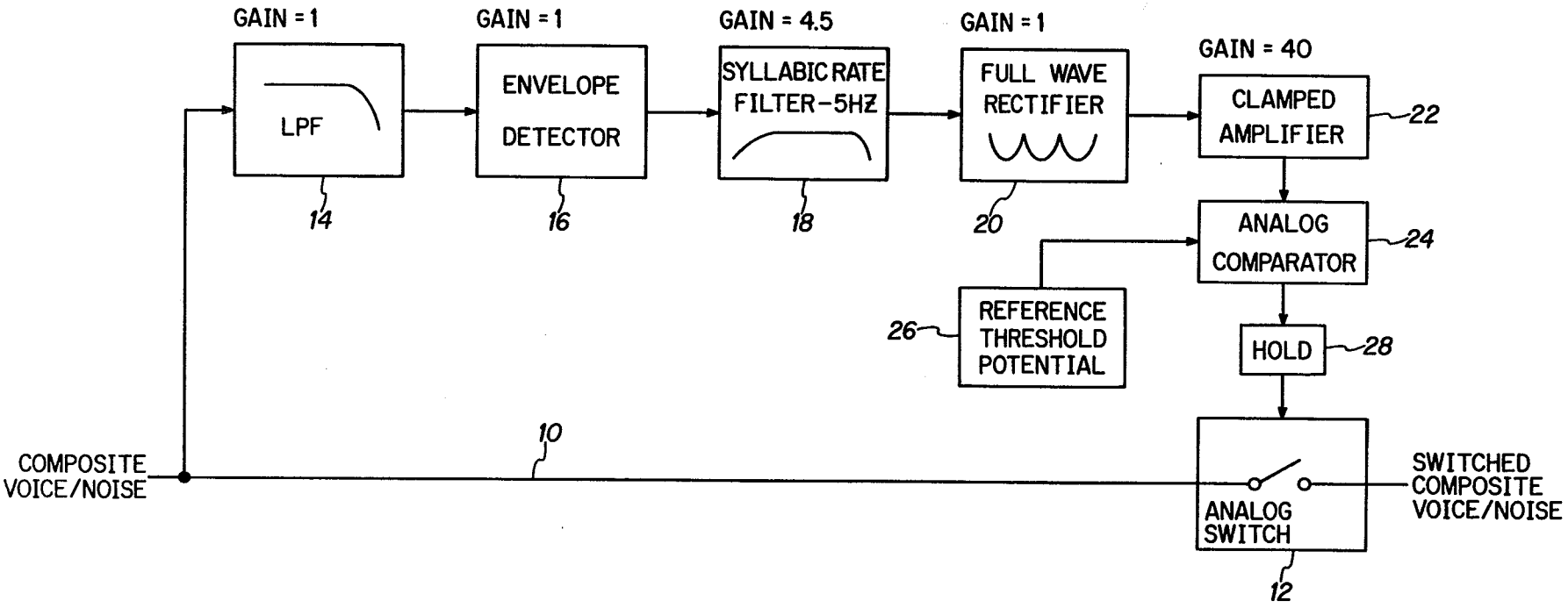
FIG. 1 is a block diagram according to the preferred embodiment of the present invention.

FIG. 1 depicts, in block diagram form, the voice operated switch according to the preferred embodiment of the present invention. A broad overview of the invention will be given first, followed by a detailed disclosure.

A transmission channel 10 couples composite voice and noise signals from, for instance, a communication voice line or a radio received IF, to other circuitry such as an audio amplifier, not shown. The transmission channel 10 is enabled and disabled by an analog switch 12 in series with such channel. The voice detection circuits are responsive to the presence or absence of the voice signal component to control the analog switch 12.

More particularly, the low pass filter 14, the envelope detector 16 and the syllabic rate filter 18 comprise the circuitry for separating the voice signals from the noise signals to generate other signals representative of the presence of the voice signal component. It should be noted that the gain of each such stage is made as close to unity as possible. In this manner the composite voice and noise signals appearing at the input of the VOX are subject to minimum amplification so that the signal to noise ratio of the processed signal, and thus its sensitivity, is preserved. It will be discussed in connection with FIG. 2 why the gain of the syllabic rate filter 18 is greater than unity.

The amplifier 22 provides the requisite amplification to produce a two-state signal of sufficient amplitude to drive an analog comparator 24. The output of amplifier 22 is clamped such that its output low level state is an indication of the absence of voice signals, and the output high level state represents an indication of the presence of voice signals.

The two-state output of the clamped amplifier 22 is then compared with an adjustable reference threshold potential 26 to determine if the analog switch 12 should enable or disable the transmission channel 10. The maximum reference potential is greater than the amplifier output high state, and the minimum reference potential is less than the amplifier output low state. This feature of the invention allows an adjustment of the reference potential to a maximum voltage to permanently disable the transmission channel. A reference potential minimum adjustment comparably assures a permanent enabling of the transmission channel. A hold circuit 28 prevents the analog switch 12 from operating at a syllabic rate and "chopping" the voice signal at a syllabic rate.

Figure 2:
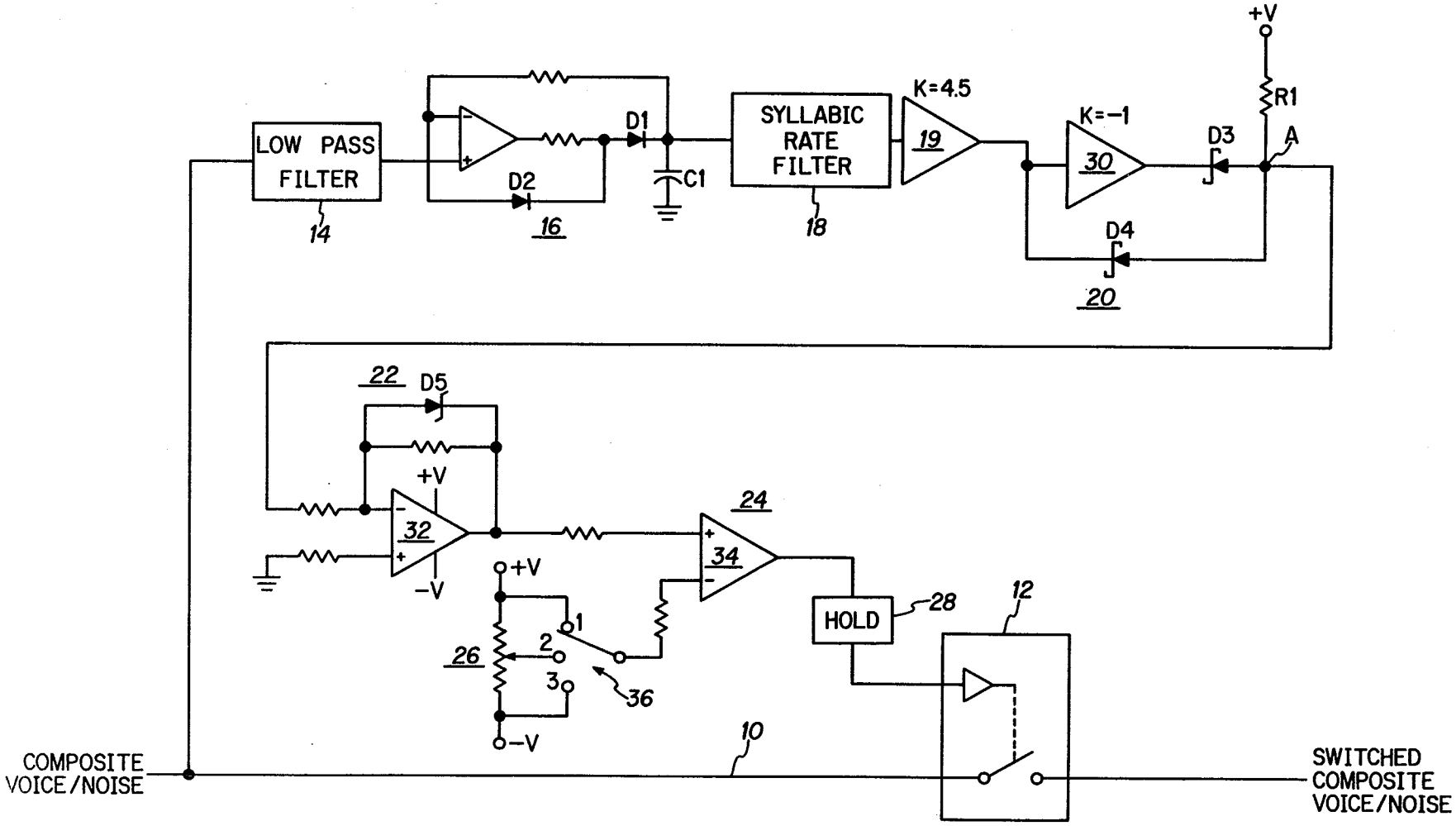
FIG. 2 is a combined block diagram and circuit schematic of the various stages of the voice operated switch.

In FIG. 2, for clarity of understanding, some of the functional blocks of FIG. 1 are shown in circuit schematic form. The preferred embodiment of the present invention is utilized in a radio receiver. In this environment the low-pass filter 14 is used to limit the frequency band to those frequencies below 750 Hz. In other applications, such as for instance a telephone subscriber line, a low-pass filter may not be required because the electrical characteristics of such line inherently limit transmission to these lower frequencies.

As noted previously, one feature of the invention is to produce an indication of the presence of voice signals without disturbing the signal to noise ratio. To that end, the voice operated switch stages up to and including the envelope detector 16 include a gain as close to unity as possible. A conventional ideal diode detection 16 is provided with unity gain to detect low level signals. Such a detector eliminates diode offset voltage and permits small amplitude signals to be processed without amplification. The diodes D1 and D2 are poled to produce positive polarity output signals. Other configurations providing for ideal diode characteristics may of course be used.

The positive signals of the detector 16 are tracked by capacitor C1 to form an envelope. The value of the capacitor C1 is chosen such that the voltage developed thereacross is representative of the envelope of the inband composite voice and noise signals.

The syllabic rate filter 18 is also of conventional design having a center frequency of 5 Hz and 3 db points at 3 Hz and 9 Hz. Such a filter processes the detected envelope to further separate the voice component from the noise component. The syllabic rate filter eliminates the higher frequency noise component and produces an output signal which varies in time according to the syllabic content of the voice component. It should be noted that the presence of the syllabic rate signal is therefore a direct indication of the presence of the voice signals on the transmission channel 10.

It should also be noted that the syllabic rate filter 18 is of the type which processes the signals without the insertion of offset or bias voltages. In other words, the syllabic rate signal coupled to the full-wave rectifier stage 20 is referenced around the ground potential. The absence of an offset voltage is significant when considering the operation of the full-wave rectifier 20.

In brief summary, it is seen that the circuit stages up to and including the syllabic rate filter greatly enhance and distinguish the syllabic rate energy components of the detected envelope, relative to other frequency components.

A full-wave rectifier 20 is employed chiefly to develop a unipolar signal so that subsequent stages can compare the amplitude of such signal with a single reference voltage. In this manner, a single threshold level can be used rather than comparing a bipolar signal with a high and low threshold level.

The full wave rectifier requires two inputs, one 180 degrees out of phase with respect to the other. Amplifier 30 provides this phase inversion. Schottky diodes D3 and D4 are poled so that the combination produces a negative full-wave rectified representation of the signal appearing at the output of the syllabic rate filter 18.

Diodes D3 and D4 are forward biased by resistor R1 current. Upon reactification of input signals, diodes D3 and D4 introduce an offset of 0.3 volts at node A. The introduction of offset at this point prevents syllabic rate signal with an amplitude of less than 0.3 volts from appearing at node A and thus at the input of amplifier 22. It should now be apparent that some amplification must precede the full-wave rectifier in order that low level composite voice signals can be processed with sufficient amplification to overcome the 0.3 volt offset. The 0.3 volt offset threshold essentially performs a peak detector function which discriminates against voice signal component amplitudes to pass acceptable syllabic rate voice signal components and reject unacceptable components. In the preferred embodiment, this offset threshold is fixed as contrasted to the comparator stage variable threshold which performs a different function to be discussed later.

The gain represented by amplifier 19 in FIG. 2 is for the purpose of producing the proper scaling between the input to the voice operated switch, and the 0.3 volt offset at node A. If syllabic rate filter 18 is an active filter, then this gain can be incorporated in the construction of filter 18. If the syllabic rate filter is a passive device, then the gain can be provided by separate amplifier as illustrated. Assuming a nominal composite voice signal level of zero VU, the appropriate gain corresponding to amplifier 19 is 4.5. By way of example, if the nominal signal level were −20 VU, then the gain of amplifier 19 should be 45. If conventional silicon diodes with a 0.6 volt threshold are used instead of the Schottky type diodes illustrated, then amplifier 19 should have a gain of about 9, rather than 4.5.

It is important to note that the gain of amplifier 19 is only applied to the syllabic rate energy (5 Hz) and not to the noise.

The signal voltage appearing at node A appears as an input to the clamped amplifier 22. The clamping amplifier 22 amplifies the node A signals, again with respect to ground, by a factor of about 40. It is evident that the majority of amplification within the VOX stages occurs after the syllabic rate signal has been separated from the noise.

It can be seen from FIG. 2 that amplifier 32 of stage 22 operates between the +V and −V supply. It is thus evident that a rectifed signal peak extending below ground by 0.25 volts or more will drive the output of amplifier 32 upward to +V. However, Zener diode D5 prevents the output voltage of the amplifier 32 from being driven to the +V, −V limits. Zener diode D5 is a silicon diode having a 3.9 volt breakdown voltage. Therefore, the amplifier output voltage is maintained at −0.6 volts for the absence of voice signals, and limited to +3.9 volts for the presence of voice signals. The 3.9 volt level is the high state and the −0.6 volt level is the low state.

In brief review, the full-wave rectifier stage 20 provides an offset so that small signals, which cannot be denominated as either voice or low frequency noise, are not thereafter processed. This aspect of the invention enhances the overall discriminatory sensitivity of the VOX circuit. The amplifier stage 22 generates a digital output voltage having a high state representative of the presence of voice signals, and a low state representative of the absence of voice signals. The digital high state and low state voltage levels correspond respectively to the reverse and forward voltage drops of the Zener diode D5. The significance of the high and low states as applied to the comparator stage 24 will be described next.

The comparator stage 24 essentially compares the amplifier high and low states with a threshold potential to produce an output indicative of the presence or absence of voice signals to thereby enable or disable the transmission channel 10.

In achieving one feature of the present invention, the reference threshold potential 26 is adjustable to a maximum value +V, and a minimum value −V, where such values are greater and less than the respective voltage levels of the amplifier high and low states. A maximum threshold voltage adjustment (+V) allows the comparator to override any amplifier output indication to thereby assure the nontransmission of signals irrespective of the presence or absence of voice signals. Correspondingly, a minimum threshold voltage adjustment (−V) allows the comparator to again override any amplifier output indication to thereby assure the transmission of signals whether or not voice signals are present.

Since the comparator 34 responds to these two-state signals appearing at its input, there is no need to continually adjust the threshold potential 26 to accommodate changes in the voice signal input level appearing on the transmission channel. In essence, the determination of the presence or absence of a voice signal is made before the comparator stage. Therefore, the comparator does not function as a variable peak detector but rather determines the digital state to either open or close the analog switch 12.

While the comparator amplifier inverting input could be connected directly to the wiper arm of the threshold potentiometer, a switch 36 can be added to take advantage of the aforementioned feature. The threshold switch 36 can be switched to position 1 to assure that the transmission channel switch 12 is open. With a reference threshold potentiometer wiper arm setting generally midway between its extreme positions, a switch setting at 2 allows the comparator to enable the transmission channel analog switch 12 in the presence of voice signals and disable the analog switch 12 in the absence of voice signals. A switch setting at 3 assures that the transmission channel analog switch 12 remains closed irrespective of the presence or absence of voice signals.

It should be noted that the comparator amplifier 34 can drive the analog switch 12 through a hold circuit 28. This hold circuit keeps the analog switch 12 closed for a minimum period of time after the comparator output changes from the high state to the low state. Since the abovedescribed VOX circuit responds to voice signals on a syllable-by-syllable basis, the hold circuit 28 provides a means by which the composite voice and noise signals appearing at the output of the transmission channel are not chopped or switched at a syllabic rate.

In summary, the present invention provides a voice operated switch having a high degree of resolution for distinguishing between the presence or absence of voice signals, and a threshold control circuit with a feature which enables the transmission channel to be enabled or disabled irrespective of the presence or absence of such voice signals.

The specific embodiment disclosed herein is intended to be exemplary of the principles of the invention and are not restrictive thereof since various modifications, readily apparent to those familiar with the art, may be made without departing from the spirit and scope of the invention as claimed herein below:

What we claim is:

1. A circuit for detecting the presence of voice energy in a composite voice and noise signal, comprising:

means for separating the voice signals from the noise signals to produce an indication of the presence of said voice signals, including:

means for producing an envelope waveform of the composite voice and noise signal a syllabic rate filter for extracting the syllabic rate content of the voice signal from said envelope waveform, and means, including an amplifier, for amplifying only acceptable syllabic rate content exceeding an offset threshold and thereby discriminating against unacceptable syllabic rate components, said amplifier having the majority of the circuit gain such that the output thereof is driven to one state during the presence of said acceptable syllabic rate content, and said output is driven to another state during the absence of said acceptable syllabic rate content;

whereby said one state is representative of the presence of voice signals and said other state is representative of the absence of voice signals.

2. The circuit for detecting the presence of voice energy as set forth in claim 1 wherein said amplifier is a unipolar amplifier, and wherein said circuit further includes a full-wave rectifier interposed between said syllabic rate filter and said amplifier, said full-wave rectifier having a gain essentially equal to unity.

3. The circuit for detecting the presence of voice energy as set forth in claim 2 wherein said full-wave rectifier includes a pair of Schottky diodes.

4. The voice operated switch of claim 1 wherein said means for producing an envelope waveform includes zero offset so that voice signals are detected irrespective of the amplitudes thereof.

5. The voice operated switch of claim 1 further including a comparator for comparing the output states of said amplifier with an adjustable reference potential to drive said switch, the maximum voltage of said reference potential being greater than one output state and the minimum voltage thereof being less than the other output state, whereby an adjustment of said reference potential to said maximum voltage or to said minimum voltage assures a respective permanent disabling or enabling of said transmission channel.

6. The voice operated switch of claim 5 wherein said maximum voltage and said minimum voltage are essentially equal to the respective +V and −V supplies of said amplifier, and wherein said amplifier includes means for clamping the voltage levels of said output states to levels intermediate said +V and −V supplies.

7. The voice operated switch of claim 5 wherein the threshold potential appearing at the input of said comparator is selected from the group consisting of the three values:

(a) said maximum voltage (b) said minimum voltage, and (c) a voltage intermediate (a) and (b) voltages.

8. A voice operated switch for enabling or disabling a transmission channel in response to the respective presence or absence of voice signals, comprising:

envelope detector means for detecting the envelope of composite voice and noise signals;

syllabic filter means for generating syllabic rate signals corresponding to the syllabic content of said envelope;

amplifier means for amplifying said syllabic rate signals an amount sufficient to produce a first output state, and a second output state in response to the absence of said syllabic rate signals;

offset threshold means for preventing said amplifier means from amplifying syllabic rate signals falling below a predetermined amplitude; and a comparator for comparing the output state of said amplifier with an adjustable reference potential, the maximum potential thereof being greater than said first output state, wherein an adjustment thereto disables said transmission channel, and the minimum potential thereof being less than said second output state, wherein an adjustment thereto enables said transmission channel.

* * * * *